US006622696B2

(12) United States Patent
Witzel et al.

(10) Patent No.: US 6,622,696 B2
(45) Date of Patent: Sep. 23, 2003

(54) THROTTLE VALVE HAVING A LARGE DIAMETER SHAFT WITH INTEGRAL VALVE PLATE

(75) Inventors: Donald G. Witzel, Pittsford, NY (US); David M. Evans, Mendon, NY (US)

(73) Assignee: Delphi Technologies, Inc., Troy, MI (US)

( * ) Notice: Subject to any disclaimer, the term of this patent is extended or adjusted under 35 U.S.C. 154(b) by 41 days.

(21) Appl. No.: 10/066,840

(22) Filed: Feb. 4, 2002

(65) Prior Publication Data

US 2003/0145824 A1 Aug. 7, 2003

(51) Int. Cl.[7] ..... F02D 9/16
(52) U.S. Cl. ..... 123/337; 251/309; 251/366
(58) Field of Search ..... 123/337; 251/309, 251/366

(56) References Cited

U.S. PATENT DOCUMENTS 3,233,865 A * 2/1966 Panzica et al. ..... 251/309
5,678,594 A 10/1997 Hill ..... 137/338
5,749,335 A 5/1998 Flanery, Jr. et al. ..... 123/337

* cited by examiner

*Primary Examiner*—Tony M. Argenbright
(74) *Attorney, Agent, or Firm*—Patrick M. Griffin

(57) ABSTRACT

A rotary throttle valve having a first cylindrical bore for flow of air between an inlet and an outlet and a second cylindrical bore orthogonal to the first bore and being substantially the same diameter as the first bore. A flow modulator rotatably disposed in the second bore has first and second cylindrical portions disposed respectively on opposite sides of the first bore and separated by a central plate such that when the modulator is rotated to place the plate transverse to the first bore, the edges of the plate are fully engaged with the wall of the second bore and the valve is closed. As the modulator is rotated from the closed position to open the valve, the edges of the plate become progressively less engaged with the wall of the second bore, the edge of the open area following the juncture lines of the first and second bores.

13 Claims, 5 Drawing Sheets

THROTTLE VALVE HAVING A LARGE DIAMETER SHAFT WITH INTEGRAL VALVE PLATE

TECHNICAL FIELD

The present invention relates to valves having rotatable valve plates for throttling the flow of gas; more particularly, to throttle valves for internal combustion engines; and most particularly, to a throttle valve having a throttle shaft of about the same diameter as the valve throat and having a valve plate integral with the shaft.

BACKGROUND OF THE INVENTION

Throttle-type valves for controlling the flow of gas are well-known. In the prior art, one type of conventional throttle valve typically comprises a body having a relatively is large-diameter first bore therethrough for passage of gas and a second relatively small-diameter bore transverse to the first bore for supporting a rotatable shaft on which is mounted a valve plate (known in the art as a "butterfly") for controllably occluding the first bore in response to rotation of the shaft to control the flow of gas. For clarity in the following presentation, such valves are referred to as prior art butterfly valves.

Several problems exist in conventional prior art butterfly throttle valves.

First, although the air bore, or throat, of the valve body is typically cylindrical, the valve plate is not circular but preferably is slightly elliptical such that the bore is sealed with the valve plate non-orthogonal to the axis of the bore. This is intended to prevent the plate from becoming jammed, or "corked," in the bore in the closed position. This problem can easily occur because the clearances between the valve plate and air bore in the closed position must necessarily be as small as is practically possible to minimize air leakage past the plate. Particularly in very small-displacement engines, the leakage inherent in prior art valves can be unacceptably large and irreducible without large expense in increased manufacturing control of component variability.

Second, because the valve plate is much larger in diameter than the diameter of the shaft bore, the plate cannot be formed integrally with the shaft but rather must be formed separately and mounted onto the shaft during assembly of the valve, typically by a pair of screws, after the shaft is installed into the valve body. Because of necessary tolerances in the manufacture of all components, significant and undesirable variation among valves occurs in the "ship air" volume (referring to the inherent leakage through the closed valve) of the valves as shipped from the manufacturer.

Third, the geometric relationship of the valve plate to the valve bore in a prior art butterfly valve is inherently and geometrically poor for precise flow control of gas at very low opening angles, which unfortunately is where high precision is very desirable. As the valve plate begins to rotate away from the closed position against the valve body, the entire circumference of the plate loses contact with the bore wall simultaneously, and gas flows around the entire metering perimeter of the plate; thus, the flow of gas through the valve increases from the ship air volume very rapidly with rotation of the valve plate through very small angles from closed.

U.S. Pat. No. 5,678,594 discloses a second type of prior art throttle valve which overcomes the first two of these problems but not the third. As shown presently in FIGS. 1–3 (corresponding to the prior art FIGS. 2, 3 and 6, respectively), and discussed here for clarity of presentation of the prior art, a throttle valve 10 includes a valve body 12 defining a flow path extending from a cylindrical inlet 14 to a cylindrical outlet 16 having axes 15,17, respectively. The flow path is not smoothly cylindrical from inlet 14 to outlet 16 but rather is provided with transverse arcuate portions 18 (shown as "90" in the reference patent) purportedly to reduce the aerodynamic torque on the valve and thus reduce actuation load. Because the portions 18 lie on opposite sides of the upper and lower portions of the valve, respectively, as shown in FIG. 3, inlet 14 is axially offset from outlet 16.

Valve body 12 is configured to be mounted in a duct and has two opposed 103 coaxial circular portals 20, 22 defining a cylindrical bore 24 through valve body 12 transverse of axes 15,17 and forming opposed linear sealing lips 26 defining a longitudinal valve seat in body 12.

A cylindrical "flow modulator" 28 includes a central rectangular valve plate 30, analogous to a prior art butterfly, extending from a first edge 32 to a second edge 34. Perpendicular to these edges, plate 30 is bounded by first and second disk flanges 36,38 of substantially the same outer diameter as the diameter of bore 24 and of the width between edges 32 and 34. Flow modulator 28 also includes a small-diameter shaft portion 40 which is captured in bearings (not shown) and used for conventional rotary actuation (not shown) of the flow modulator. Edges 32,34 seal linearly against the valve seat defined by lips 26 over the entire length of the edges and lips when the valve is closed, unlike a prior art butterfly valve which seals radially against a cylindrical bore.

The valve disclosed in U.S. Pat. No. 5,678,594 and just described suffers from the same geometric disadvantage as the conventional butterly valves described earlier, leading to inherently imprecise flow control of gas at very low opening angles. As shown in FIG. 3, as the valve plate 30 begins to rotate away from the closed position, the entire lengths of edges 32,34 lose contact with the lips 26 simultaneously, and gas begins flowing across the entire metering length of edges 32,34; thus, the flow of gas through the valve increases very rapidly with rotation of the valve plate through very small angles from closed.

Therefore, there is a strong need for an improved throttle valve wherein the flow of gas through the valve increases slowly with rotation of the valve shaft as the valve is opened.

It is a principal object of this invention to provide an improved throttle valve wherein the flow of gas through the valve increases slowly with rotation of the shaft as the valve is opened.

It is a further object of this invention to provide an improved throttle valve wherein the minimum air flow is substantially lower than that routinely achievable with prior art valves.

It is a still further object of the invention to provide an improved large-shaft throttle valve wherein the shaft is journalled in the valve body without requiring roller bearings.

It is a still further object of the invention to provide an improved throttle valve wherein the volume of idle air for each individual valve is independently adjustable after assembly such that all such valves may be adjusted to a standard ship air volume.

It is a still further object of the invention to provide an improved throttle valve requiring fewer components and therefore costing less to manufacture.

SUMMARY OF THE INVENTION

Briefly described, the present invention is directed to an improved rotary throttle valve. A valve body has a first cylindrical bore for flow of gas, such as air, therethrough between an inlet and an outlet. Orthogonal to the first cylindrical bore is a second cylindrical bore having substantially the same diameter as the first bore. A flow modulator rotatably disposed in the second bore has first and second cylindrical portions disposed respectively on opposite sides of the first bore and separated by a central plate having a width equal to the diameters of the first and second bores such that when the modulator is rotated to place the width of the plate transverse to the first bore, the edges of the plate are fully engaged with the wall of the second bore and the valve is closed. As the modulator is rotated from the closed position, the edges of the plate become progressively less engaged with the wall of the second bore, the edge of the open area following the juncture lines of the first and second bores, and the open area of the first bore increases accordingly.

Preferably, an adjustable air bleed valve is provided for calibrating a standard minimum air flow through the closed valve. A threaded axial bore in the flow modulator extends through one of the cylindrical portions into the metering plate and exits through the opposite surfaces of the plate to provide pinhole orifices on either side of the plate in the gas flow path. A screw or needle valve in the bore adjusts the volume of bleed air passing through the plate when the valve is closed.

BRIEF DESCRIPTION OF THE DRAWINGS

The foregoing and other objects, features, and advantages of the invention, as well as presently preferred embodiments thereof, will become more apparent from a reading of the following description in connection with the accompanying drawings in which.

DESCRIPTION OF THE PREFERRED EMBODIMENTS

Figure 1:
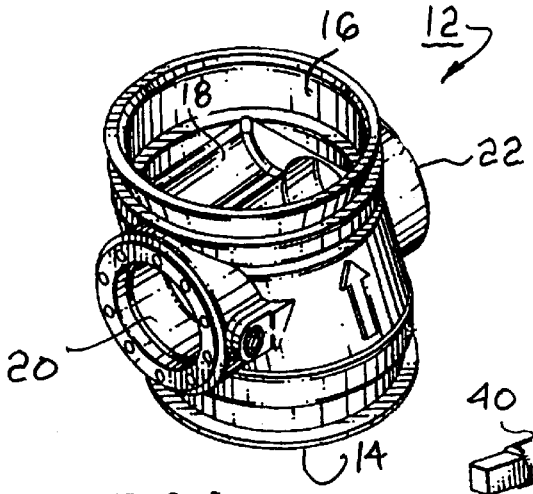
FIG. 1 (PRIOR ART)
FIG. 1 is an isometric view of the valve body of a prior art large-shaft throttle valve.
Figure 2:
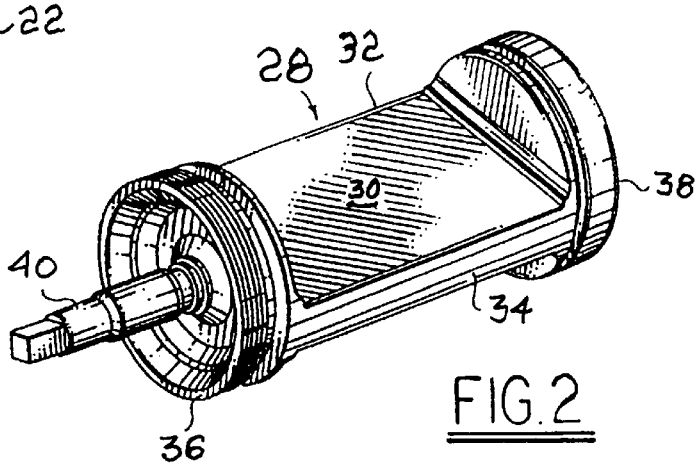
FIG. 2 (PRIOR ART)
FIG. 2 is an isometric view of a prior art flow modulator for use in the valve body shown in FIG. 1.
Figure 3:
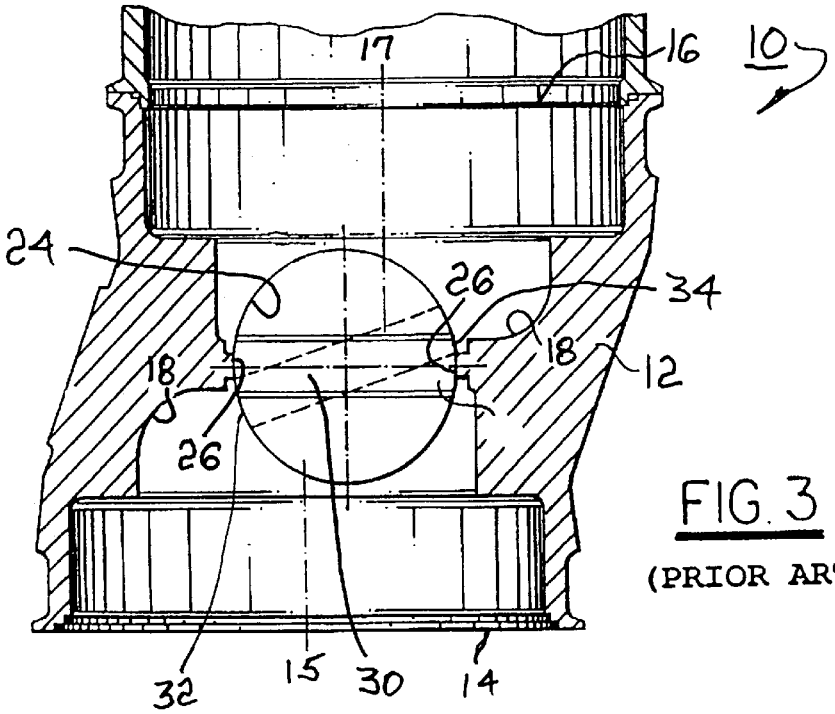
FIG. 3 (PRIOR ART)
FIG. 3 is an elevational view, partially in cross-section, of a prior art valve assembled from the components shown in FIGS. 1 and 2.

The particular advantages of a throttle valve in accordance with the invention may be better appreciated by first considering a prior art large shaft-diameter throttle it valve. Such a valve has been discussed hereinabove; accordingly, prior art FIGS. 1–3 need not be treated here again.

Referring to FIGS. 4 through 11, a throttle valve 10' in accordance with the invention includes a valve body 12' having a first bore 13 extending from a cylindrical inlet 14' to a cylindrical outlet 16' which have a common axis 21. Bore 13 preferably is flared slightly conically in both directions from a circular midpoint having a diameter $D_1$ and defines a path for the flow of gas through body 12'.

The valve body 12' is configured to be mounted in a duct, for example, between an air cleaner 19 and the inlet manifold 19' of an internal combustion engine 25, and has two opposed coaxial circular portals 20', 22' defining a cylindrical bore 24' through valve body 12'. Bore 24' has an axis 23 intersecting orthogonally axis 21. Bore 24' has a diameter $D_2$ preferably substantially identical to diameter $D_1$ of bore 13. A flow modulator 28' defines a large diameter throttle valve shaft having an integral valve plate 30' extending from a first edge 32' to a second edge 34'. Perpendicular to these edges, plate 30' is bounded by first and second disk flanges 36',38' of substantially the same outer diameter as the diameter of bore 24' and of the width between edges 32' and 34'. Flow modulator 28' may also include at one end a small-diameter shaft portion 40' which may be captured, for example, by a conventional throttle rotation position sensor 42 mounted on valve body 12'. At the opposite end, flow modulator 28' may be conveniently provided with a throttle cam 44 for receiving a throttle cable (not shown) and a throttle return spring 45.

Figure 9:
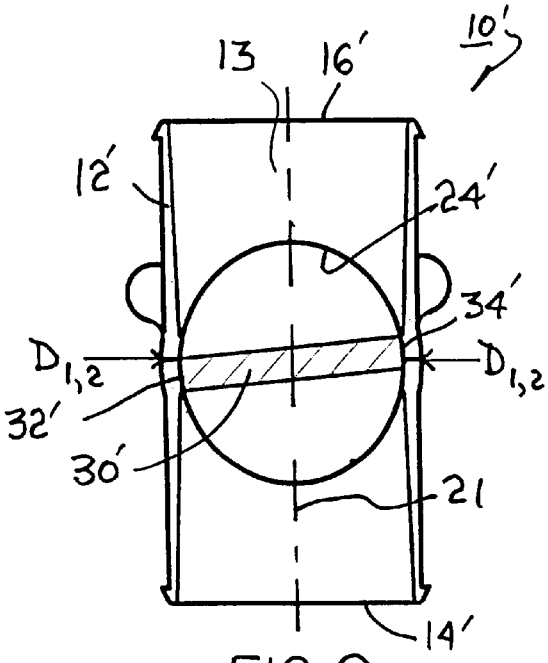
FIG. 9 is a cross-sectional view of the valve shown in FIG. 8, taken along line 9—9.
Figure 10:
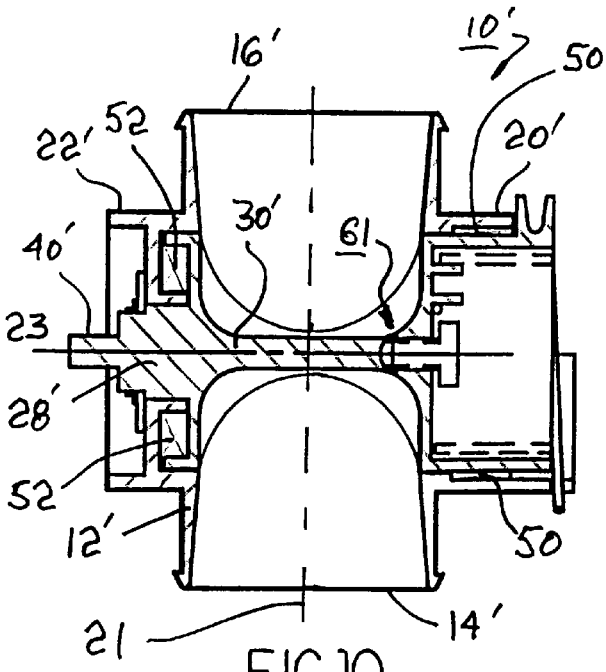
FIG. 10 is a cross-sectional view of the valve shown in FIG. 8, taken along line 10—10.

Edges 32',34' seal against the valve seat defined by second bore 24' over the entire length of the edges when the valve is closed, as shown in FIGS. 9 and 10, which valve seat coincides with the wall of first bore 13. As flow modulator 28' begins to be rotated from the closed position (counterclockwise in FIG. 9), edges 32',34' begin to lose contact with first bore 13 only at the longitudinal center of edges 32',34'. As rotation progresses, loss of contact progressively spreads along the edges, following the juncture line of bores 13 and 24', and gradually increasing the metering length of edges 32',34'. This is in sharp contrast to prior art valve 10 wherein the metering length of edges 32,34 is maximized instantaneously when modulator 28 begins to rotate from a closed position.

It will be obvious that the diameter $D_2$ of bore 24' may be greater than diameter $D_1$ of bore 13, but not smaller, to permit an integral plate 30' to fully occlude bore 13.

Figure 12:
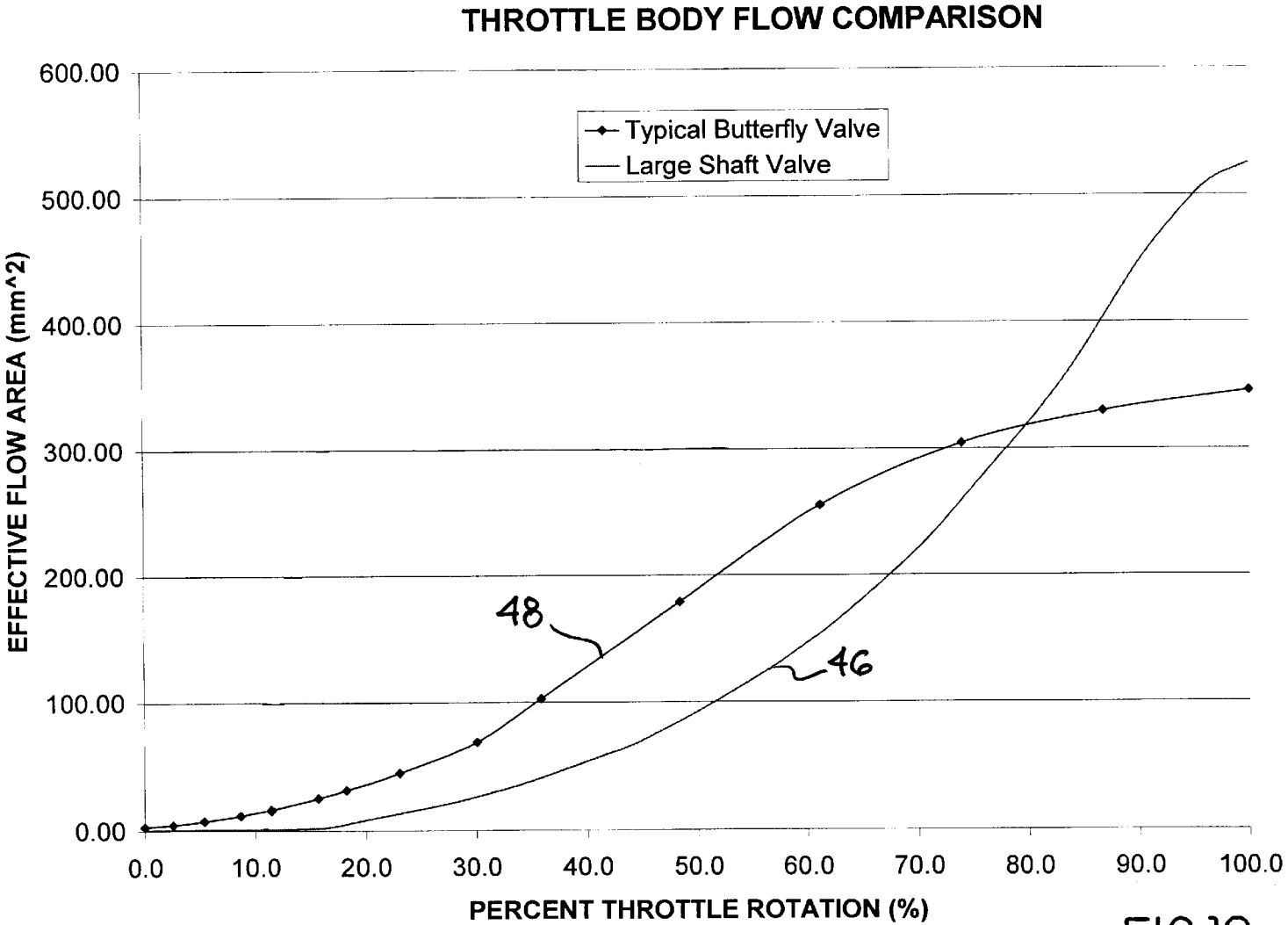
FIG. 12 is a graph showing the progress of effective flow area as a function of throttle rotation from a closed position for a prior art butterfly valve and for a valve in accordance with the invention.

Referring to FIG. 12, the advantage conferred by improved valve 10' (curve 46) over a conventional prior art butterfly valve (curve 48) is obvious. For valve 10', throttle rotation up to about 30% of full rotation produces an effective flow area of less than 30 $mm^2$, whereas a conventional valve has more than double that flow area at the same percent rotation. Valve 10' thus exhibits much greater control sensitivity in the early stages of valve opening, which is highly desirable for engine control near idle and particularly in small displacement engines. Further, plate 30' can be made substantially thinner than the diameter of a rod-shaped valve shaft of a conventional butterfly valve without sacrificing structural rigidity; thus plate 30' inherently occludes significantly less of bore 13 than does a conventional shaft when the valve is wide open (greater than about 75% throttle rotation), thus providing significantly greater effective flow area than is possible with the conventional butterfly valve having the same diameter air bore.

The shape of the opening portion of curve 46 can readily be changed as desired by altering the shape or the thickness of plate 30' in the region of edges 32' and 34'. For example, one or both of edges 32',34' may be tapered to be substantial knife edges (not shown) or may be grooved transversely or otherwise tailored.

A problem with prior art throttle valves is that the demanding tolerances of the throttle body, and especially the necessary roundness of the air bore, cannot be met inexpensively by injection molding of the component from plastic polymer. Thus, throttle valves having uniformly low ship air volumes typically include throttle bodies formed expensively by die casting of metal. Known valves having throttle bodies formed by injection molding of polymers typically exhibit high and variable ship air volumes. Because the flow modulator in the improved valve does not rely on mating with the air bore 13 of the valve, roundness tolerances for the air bore can be relaxed, permitting the valve body 12' to be injection molded of a dimensionally-stable polymer, for example, a composite such as glass-filled nylon or PTFE-filled polyetherimide. Roundness of second bore 24' is also sufficient for routinely accepting and supporting flow modulator 28'.

Figure 11:
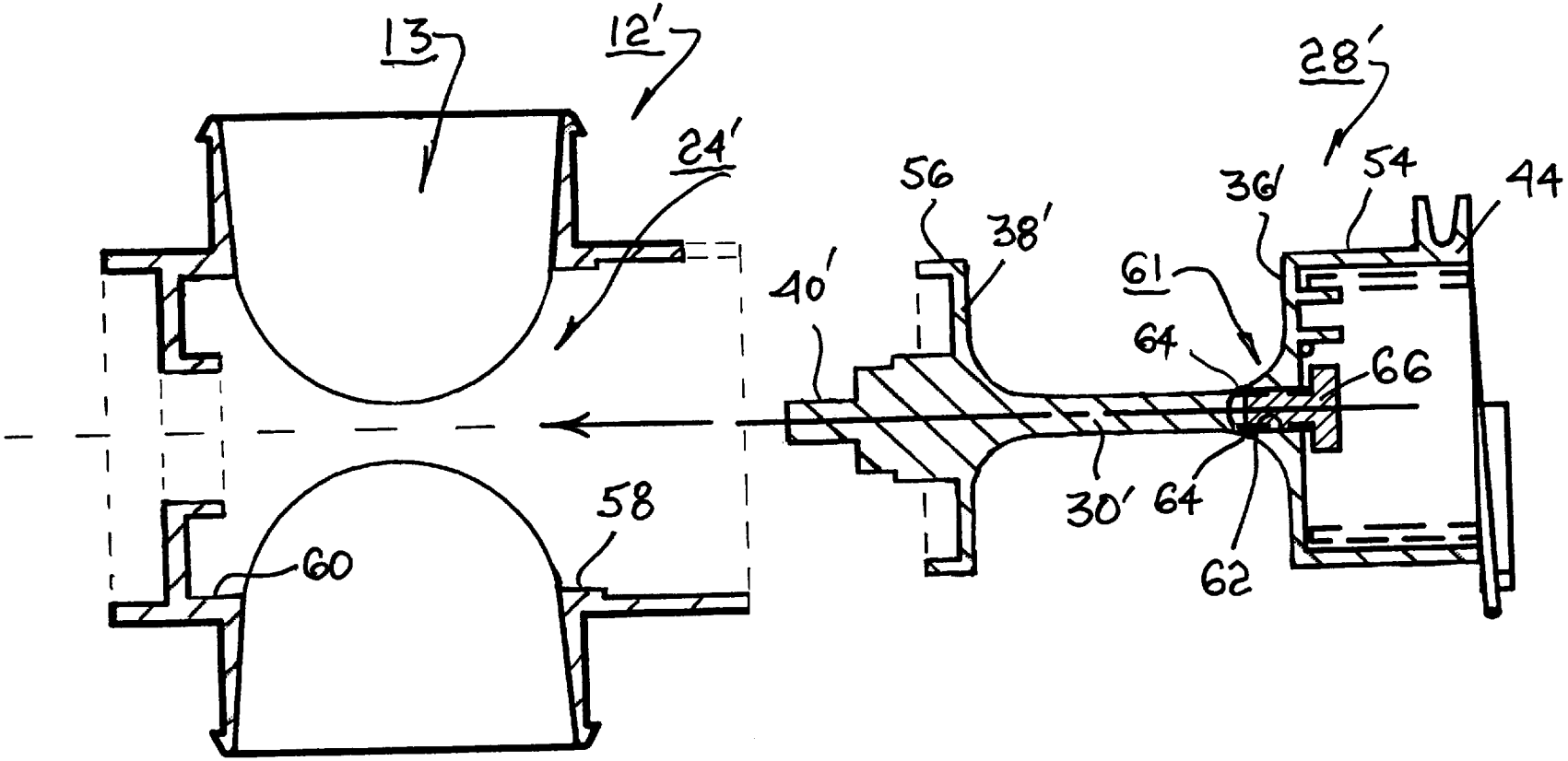
FIG. 11 is an exploded cross-sectional view of the valve shown in FIG. 10, showing assembly of the flow modulator into the valve body.

If desired for specific throttling applications, modulator 28' may be supported in bore 24' by needle bearings 50 and/or ball bearings 52, as shown in FIG. 10 and known (but not shown herein) in prior art valve 10. However, in some applications such bearings can be rendered unnecessary through careful selection of lubricious materials for forming throttle body 12'. For example, one such currently preferred material is a composite comprising polyetherimide loaded with polytetrafluoroethylene, which is available from General Electric Co., Schenectady, N.Y., USA under the trade name Ultem. Such material is strong, has excellent temperature stability, is excellent for molding, has low water absorption and low surface energy (considerations for icing propensity of a fuel throttle valve), and a low coefficient of sliding friction. In valves in accordance with the preferred embodiment, as shown in FIGS. 10 and 11, modulator 28' is borne by first and second cylindrical surfaces 54,56 in first and second journals 58,60, respectively, in valve body 12'.

An important advantage of valve 10' over a conventional butterfly valve is that the ship air flow variation due to assembly variation is minimal. In conventional valves, normal variation in placement of the butterfly onto the valve shaft results in significant variation in "closed" mating of the butterfly with the air bore of the valve. In valve 10', having a throttle plate 30' integral with modulator 28', all variation between modulator and valve body is a function solely of molding variability; assembly variation is eliminated. Further, because modulator 28' is not symmetrical end-for-end, the valve cannot be mis-assembled, an important consideration for world-wide manufacturing capability.

Valve 10' as described exhibits a low but inherent level of air leakage variability among a plurality of valves when all are in the closed position. Therefore, in a currently preferred embodiment, an adjustable secondary valve 61 is provided for bypassing a low volume of air through flow modulator 28'. Referring to FIGS. 10 and 11, an axial bore 62 in flow modulator 28' extends through disk flange 36' and partially into plate 30'. The diameter of bore 62 is selected to be slightly larger than the thickness of plate 30' such that the bore exits through the upper and lower surfaces of plate 30' at apertures 64, thereby forming a bypass air flow path through the plate. Bore 62 is threaded to receive an idle air adjusting screw or needle valve 66 which may be variably advanced in bore 62 to variably occlude the bypass air flow path. Thus, each valve 10' may be calibrated during manufacture such that the ship air volumes of all such valves 10' are standard and identical.

Figure 4:
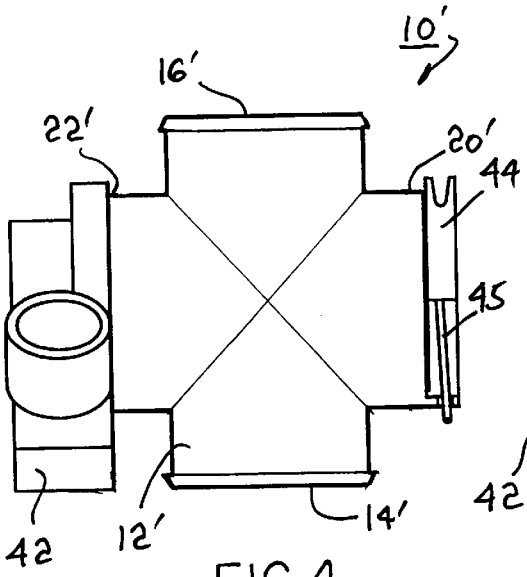
FIG. 4 is an elevational view of a throttle valve in accordance with the invention.
Figure 5:
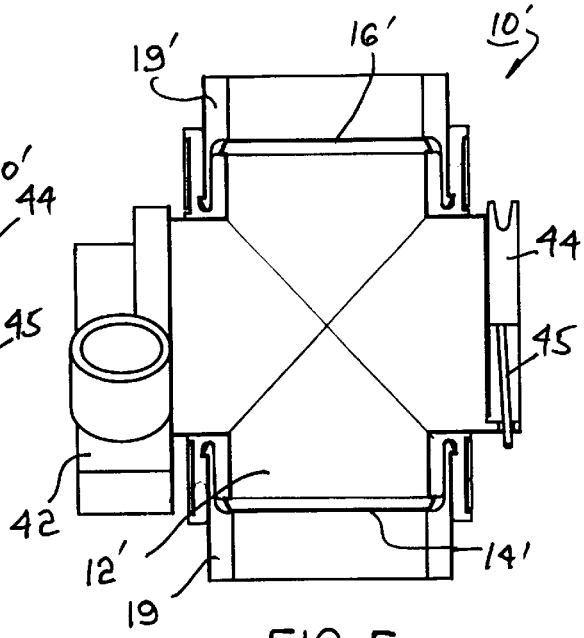
FIG. 5 is an elevational view like that shown in FIG. 4, showing the valve as incorporated into an internal combustion engine.
Figure 6:
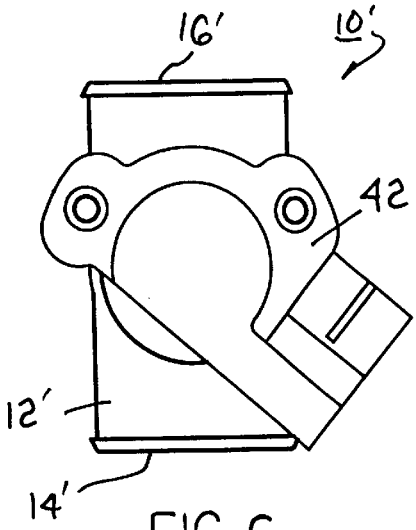
FIG. 6 is a left elevational view of the valve shown in FIG. 4.
Figure 7:
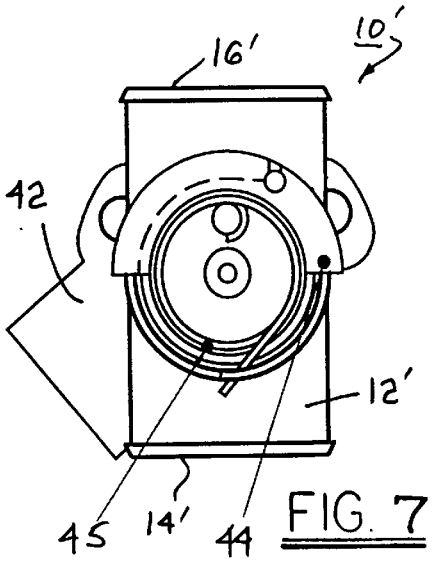
FIG. 7 is a right elevational view of the valve shown in FIG. 4.
Figure 8:
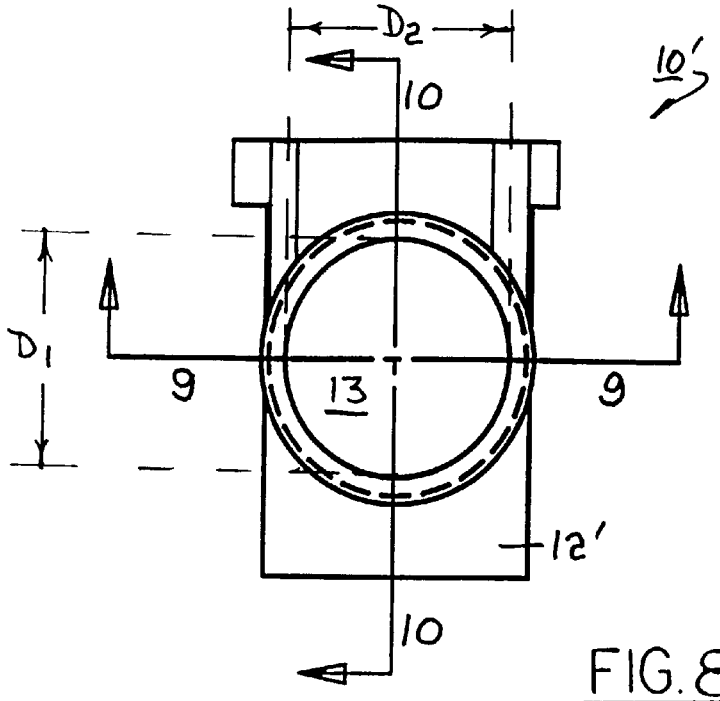
FIG. 8 is a top view of a valve in accordance with the invention and similar to the valve shown in FIG. 4.

Referring to FIGS. 4, 5, and 7, return spring 45 may be provided as a conventional multiple-turn torsion spring wherein the turns are helically aligned, or preferably, as a spiral-wound torsion spring, also known as a flat wire watch spring, intended for revolutions of 360° or less. Use of the latter type of spring reduces the transverse axial dimension required of the valve.

While the invention has been described with reference to preferred embodiments, it will be understood by those skilled in the art that various changes may be made and equivalents may be substituted for elements thereof without departing from the scope of the invention. In addition, many modifications may be made to adapt a particular situation or material to the teachings of the invention without departing from the scope of the invention. Therefore, it is intended that the invention not be limited to the particular embodiments disclosed as the best mode contemplated for carrying out this invention, but that the invention include all embodiments falling within the scope and spirit of the appended claims.

What is claimed is:

1. A valve for throttling the flow of a gas, comprising:

a) a valve body having a first bore for passage of gas therethrough, said bore having a first axis and a central portion having a first diameter, and having a cylindrical second bore having a second diameter at least as large as said first diameter and a second axis intersecting said first axis orthogonally; and b) a flow modulator rotatably disposed in said second bore, said modulator having first and second disk flanges disposed along said modulator respectively on opposite sides of said first bore and connected by a rectangular valve plate having opposed first and second linear edges disposed orthogonally to said cylindrical portions having a width between said edges substantially equal to said diameter of said second bore.

2. A valve in accordance with claim 1 further comprising at least one roller bearing supporting said flow modulator in said valve body.

3. A valve in accordance with claim 1 further comprising at least one journal surface in said valve body for matably and rotatably supporting at least one corresponding surface in said flow modulator.

4. A valve in accordance with claim 1 wherein said first bore includes an inlet portion and an outlet portion and wherein said first bore is conically flared from said central portion to at least one of said inlet portion and said outlet portion.

5. A valve in accordance with claim 1 wherein said valve body is formed of an injection-moldable polymer.

6. A valve in accordance with claim 5 wherein said polymer is a filled composite.

7. A valve in accordance with claim 6 wherein said filled composite is selected from the group consisting of glass-filled nylon and polytetrafluoroethylene-filled polyetherimide.

8. A valve in accordance with claim 1 further comprising a throttle cam formed on said flow modulator.

9. A valve in accordance with claim 1 further comprising a torsion return spring operationally disposed between said flow modulator and said valve body for urging said valve plate to a closed position within said first bore.

10. A valve in accordance with claim 1 further comprising a throttle position sensor disposed on an end of said flow modulator.

11. A valve in accordance with claim 1 further comprising an axial air bypass valve disposed in said flow modulator.

12. A valve in accordance with claim 11 wherein said axial air bypass valve comprises:

a) a threaded axial bore through one of said first and second cylindrical portions and exiting said flow modulator as first and second apertures within said first bore on opposite sides respectively of said valve plate; and b) an adjustment screw disposed in said threaded axial bore and advanceable to vary the volume of air permitted to flow through said plate via said first and second apertures and said threaded axial bore.

13. An internal combustion engine comprising a throttle valve having a valve body having a first bore for passage of gas therethrough, said bore having a first axis and a central portion having a first diameter, and having a cylindrical second bore having a second diameter at least as large as said first diameter and a second axis intersecting said first axis orthogonally, and a flow modulator rotatably disposed in said second bore, said modulator having first and second disk flanges disposed along said modulator respectively on opposite sides of said first bore and connected by a rectangular valve plate having opposed first and second linear edges disposed orthogonally to said cylindrical portions having a width between said edges substantially equal to said diameter of said second bore.

* * * * *